US011643268B2

(12) United States Patent
Chung et al.

(10) Patent No.: US 11,643,268 B2
(45) Date of Patent: May 9, 2023

(54) APPARATUS AND METHODS FOR PACKAGING AND SHIPPING WINE BOTTLES

(71) Applicant: Footprint International, LLC, Scottsdale, AZ (US)

(72) Inventors: Yoke Chung, Chandler, AZ (US); Brandon Michael Moore, Mesa, AZ (US)

(73) Assignee: Footprint International, LLC, Gilbert, AZ (US)

( * ) Notice: Subject to any disclaimer, the term of this patent is extended or adjusted under 35 U.S.C. 154(b) by 0 days.

(21) Appl. No.: 15/953,369

(22) Filed: Apr. 13, 2018

(65) Prior Publication Data

US 2019/0315564 A1 Oct. 17, 2019

(51) Int. Cl.

| | |
|---|---|
| ***B65D 25/10*** | (2006.01) |
| ***B65D 85/30*** | (2006.01) |
| ***B65B 21/02*** | (2006.01) |
| ***B65D 6/00*** | (2006.01) |
| ***B65D 71/70*** | (2006.01) |

(52) U.S. Cl.

CPC ..... *B65D 85/305* (2013.01); *B65B 21/02* (2013.01); *B65D 13/04* (2013.01); *B65D 25/108* (2013.01); *B65D 71/70* (2013.01); *B65D 2303/00* (2013.01)

(58) Field of Classification Search

CPC ..... B65D 85/305; B65D 25/14; B65D 25/10; B65D 21/02; B65D 13/04; B65D 25/108; B65D 71/70; B65D 2303/00

USPC ..... 206/433, 427

See application file for complete search history.

(56) References Cited

U.S. PATENT DOCUMENTS 3,115,247 A * 12/1963 Hauser ..... B65D 5/38 192/105 BA
3,297,191 A * 1/1967 Eastman ..... B65D 5/5059 206/427
3,722,781 A * 3/1973 Page ..... B65D 5/38 206/561
3,868,140 A * 2/1975 Gordon ..... B65D 71/004 206/139
4,037,722 A * 7/1977 Bremer ..... B65D 5/509 206/199
4,341,308 A * 7/1982 Pasquini ..... B65D 5/5052 206/427
4,378,879 A * 4/1983 Killy ..... B65D 71/44 206/158
4,644,610 A * 2/1987 Fish ..... A01G 13/04 211/70.6
4,911,300 A * 3/1990 Colonna ..... B65D 71/50 206/427

(Continued)

*Primary Examiner* — Steven A. Reynolds

(74) *Attorney, Agent, or Firm* — Jennings, Strouss & Salmon, P.L.C.

(57) ABSTRACT

Methods and apparatus for packaging and shipping wine. A shipping container includes: a vacuum molded base component having a plurality of cylindrical concave columns within which respective bottles are received; a substantially planar corrugated separator sheet having a plurality of receptors aligned with the axes of the columns and configured to slidably receive respective bottle necks associated with the bottles; a vacuum molded cap component for receiving the bottle necks therewithin; and an outer corrugated box within which the bottles, base component, separator, cap component components are securely disposed.

10 Claims, 13 Drawing Sheets

(56) References Cited

U.S. PATENT DOCUMENTS

| | | | | | |
|---|---|---|---|---|---|
| 5,267,644 | A * | 12/1993 | Tsao | B65D 71/48 | 206/151 |
| 5,323,895 | A * | 6/1994 | Sutherland | B65D 71/40 | 206/147 |
| 5,490,593 | A * | 2/1996 | Gordon | B65D 71/44 | 206/157 |
| 5,624,032 | A * | 4/1997 | Yucknut | B65D 5/4804 | 206/433 |
| 5,816,391 | A * | 10/1998 | Harris | B65D 71/44 | 206/147 |
| 5,975,300 | A * | 11/1999 | Gale | B65D 5/503 | 206/433 |
| 6,003,666 | A * | 12/1999 | Dougherty | B65D 5/22 | 206/204 |
| 6,290,057 | B1 * | 9/2001 | Hurley | B65D 5/503 | 206/203 |
| 6,325,210 | B1 * | 12/2001 | Henry, Jr. | B65D 5/503 | 206/203 |
| 6,702,115 | B1 * | 3/2004 | Roper | B65D 5/5061 | 206/427 |
| 7,617,933 | B2 * | 11/2009 | Bates | B65D 5/5038 | 206/139 |
| 8,230,997 | B1 * | 7/2012 | McWilliams | B65D 5/5038 | 206/433 |
| 8,701,884 | B2 * | 4/2014 | Williams | B65D 81/113 | 206/139 |
| 10,124,924 | B2 * | 11/2018 | Gilligan | B65D 81/133 | |

* cited by examiner

APPARATUS AND METHODS FOR PACKAGING AND SHIPPING WINE BOTTLES

TECHNICAL FIELD

The present invention relates, generally, to ecologically sustainable methods and apparatus for manufacturing wine packaging materials and shipping containers and, more particularly, to an environmentally friendly packaging configuration for shipping wine bottles using molded fiber and corrugated materials.

BACKGROUND

Pollution caused by single use packaging materials is epidemic, scarring the global landscape and threatening the health of ecosystems and the various life forms that inhabit them. Trash comes into contact with waterways and oceans in the form of bits of Styrofoam and expanded polystyrene (EPS) packaging, to-go containers, thin film bags and photo-degraded plastic pellets.

Sustainable solutions for reducing plastic pollution, including both molded fiber and corrugated cardboard materials, are gaining momentum. However, continuing adoption requires these solutions to not only be good for the environment, but also competitive with current packaging and shipping materials from both a performance and a cost standpoint. The present invention involves an improved wine packaging and shipping assembly and related methods using molded fiber and corrugated components. In addition, the present invention replaces the traditional three-dimensional fiber molded top half of a wine packaging assembly with a single, planar, corrugated sheet, further reducing cost, weight, waste, and overall complexity.

By way of brief background, molded paper pulp (molded fiber) has been used since the 1930s to make containers, trays and other packages, but experienced a decline in the 1970s after the introduction of plastic foam packaging. Paper pulp can be produced from old newsprint, corrugated boxes and other plant fibers. Today, molded pulp packaging is widely used for electronics, household goods, automotive parts and medical products, and as an edge/corner protector or pallet tray for shipping electronic and other fragile components. Molds are made by machining a metal tool in the shape of a mirror image of the finished package. Holes are drilled through the tool and then a screen is attached to its surface. The vacuum is drawn through the holes while the screen prevents the pulp from clogging the holes.

Corrugated materials are available in different wall thicknesses, known as flutes sizes. In particular, corrugated material is comprised of three fiberboard layers; two linerboards and a middle sheet comprising a wave-shaped pattern of arches known as flutes. These flutes are adhesively sandwiched between the outer linerboards.

On end, flutes form rigid columns capable of supporting substantial weight. From the side of the board, the space between the flutes acts as a cushion to protect the container's contents. Flutes also serve as a thermal insulator, providing protection from sudden temperature changes. The linerboard provides additional strength and protects the flutes from damage.

Flutes are categorized by various sizes, known as flute profiles, ranging from A-flute (the largest) to F-flute and below (microflutes):

E-Flute: 1/16" thick, 90 flutes per linear foot

B-Flute: 1/8" thick, 47 flutes per linear foot

C-Flute: 3/16" thick, 39 flutes per linear foot

A-Flute: 1/4" thick, 33 flutes per linear foot

The A-flute is the original corrugated flute design and is the thickest. A-flutes provide a high degree of cushioning for fragile products. The C-flute is the most widely used flute size, commonly used for packaging glass products. B-flutes provide a stiff, flat surface for high quality printing and die cutting. Developed for packaging canned goods, the B-flute is used for beverage trays, wrap-around blanks, glass-to-glass packs, and slipsheets.

Containing about 90 flutes per foot, the E-flute has high crush resistance and a relatively flat surface for high quality printing applications. The thin board profile of E-flute reduces outer box dimensions, and can help save storage space. The F-flute is used for specialty packaging, point-of-purchase displays, jewelry and cosmetic packages, and shoe boxes. In the United States, fast food chains are adopting F-flute materials in clamshell packaging.

In addition, the foregoing single flute configurations may be combined to form double flutes such as, for example, AE, BE, BC, AB, and the like.

Presently known non-petroleum based wine shipping assemblies include a molded fiber base (or bottom) component having individually partitioned cylindrical segments configured to receive six or twelve bottles. A molded fiber cap (or top) component includes corresponding individually partitioned conical segments configured to receive the top portions of the bottles such that, when the cap is placed over the bottles, each bottle is protected from contacting the other bottles. The entire assemble is received within a corrugated carton and sealed for shipment.

Non-standardized bottle sizes, shapes, and heights, coupled with manufacturing limitations on the size and shape of vacuum molded fiber cap components, limit the utility of the foregoing packaging assembly. For example, in many applications a gap exists between the top of the molded fiber base and the bottom of the molded fiber cap. To accommodate this deficiency, a corrugated divider includes a plurality of vertically oriented, orthogonal planar segments running between adjacent bottles to protect the bottles from contacting each other during shipment. However, the divider increases assembly and packing time, cost, material count, waste, and overall complexity.

Improved wine packaging and shipping assemblies are thus needed which overcome the limitations of the prior art.

Various features and characteristics will also become apparent from the subsequent detailed description and the appended claims, taken in conjunction with the accompanying drawings and this background section.

BRIEF SUMMARY

Various embodiments of the present invention relate to wine packaging and shipping assemblies which include: i) a vacuum molded base component having a plurality of cylindrical concave columns within which respective bottles are placed; ii) a substantially planar single or double fluted corrugated sheet (which replaces the aforementioned divider) having a plurality of expandable holes aligned with the axes of the columns, with each hole configured to slidably receive a respective bottle neck therethrough; iii) an optional vacuum molded cap component for receiving the top portions of the bottles therewithin; and iv) an outer corrugated box within which the foregoing components are secured.

It should be noted that the various inventions described herein, while illustrated in the context of wine bottles, are not so limited. Those skilled in the art will appreciate that the inventions described herein may contemplate packaging and/or shipping containers for any products which need to avoid contact with one another during shipment.

Various other embodiments, aspects, and features are described in greater detail below.

BRIEF DESCRIPTION OF THE DRAWING FIGURES

Exemplary embodiments will hereinafter be described in conjunction with the appended drawing figures, wherein like numerals denote like elements, and:

Figure 10:
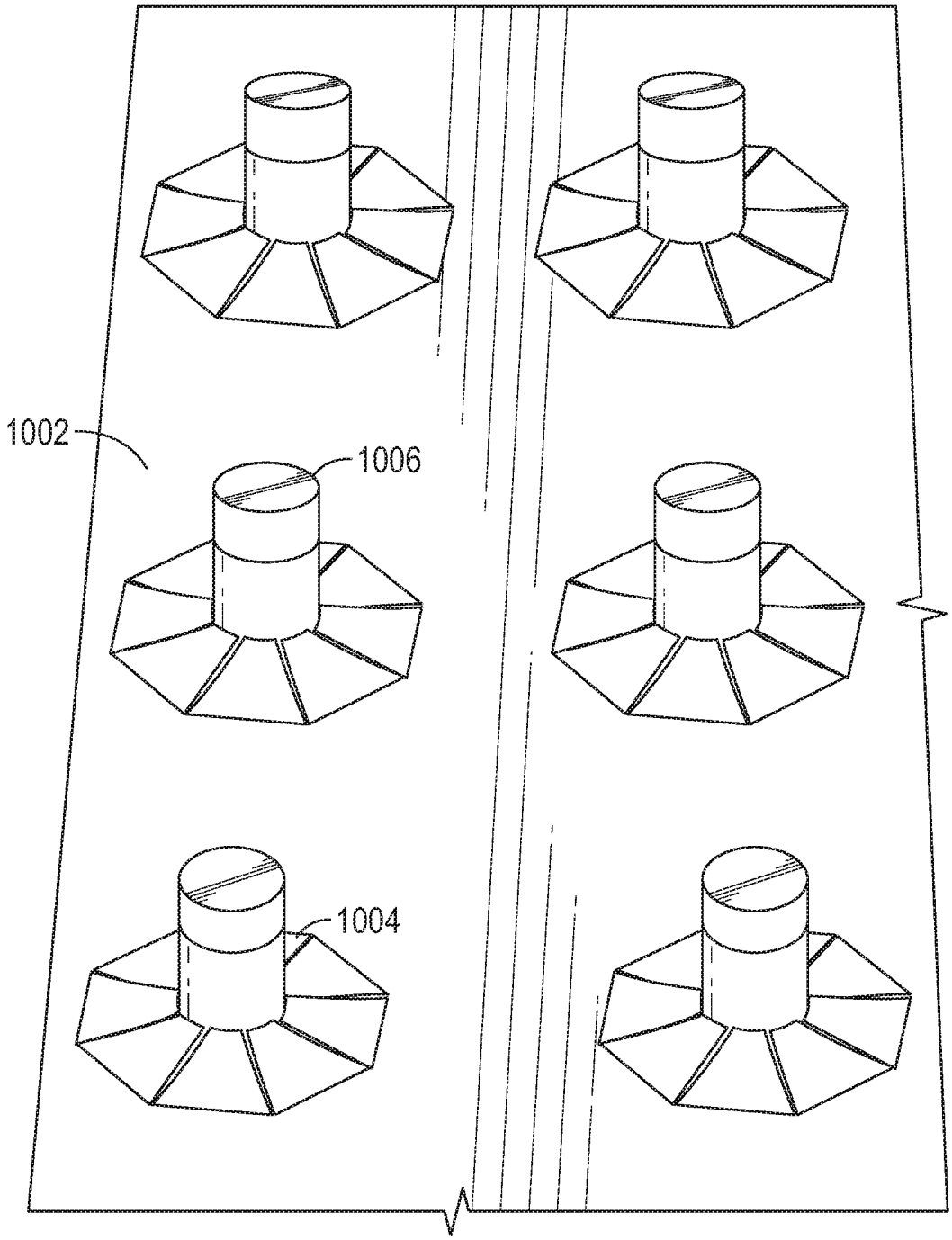
FIG. 10 is a perspective view of an exemplary separator shown securing a plurality of bottles within an outer box container in accordance with various embodiments.
Figure 17:
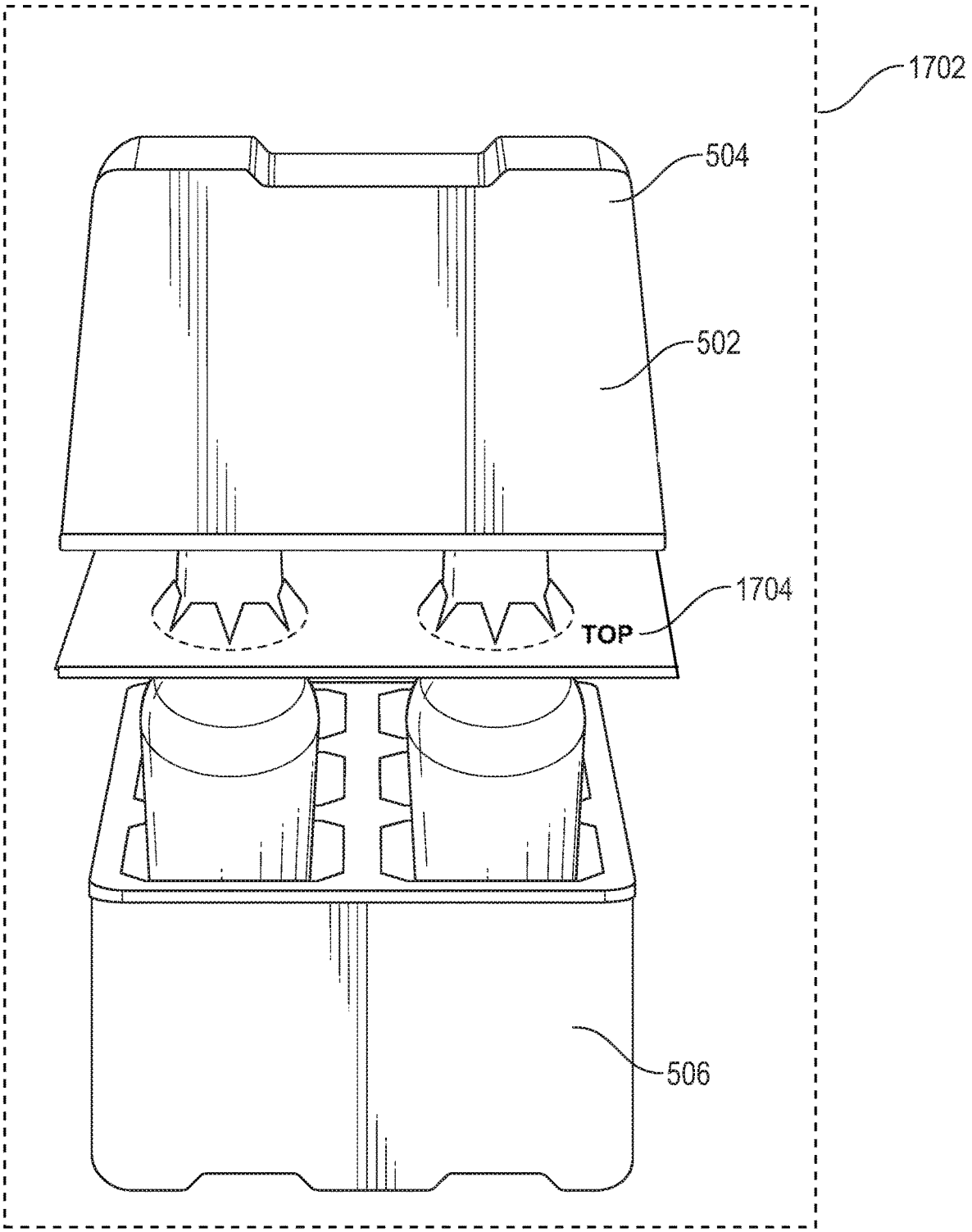

FIG. 17 is a side elevation view of the assembly in FIG. 10, further including an optional top component (cap) 502 including a plurality of concave (generally conical) segments 504 for receiving the bottle tops, where the bottles are received within a bottom component 506. A visual indicia of orientation 1704 is provided. The assembly, top component 502, and the bottom component 506 are placed within a corrugated outer box 1702.

DETAILED DESCRIPTION OF PREFERRED EXEMPLARY EMBODIMENTS

The following detailed description of the invention is merely exemplary in nature and is not intended to limit the invention or the application and uses of the invention. Furthermore, there is no intention to be bound by any theory presented in the preceding background or the following detailed description.

Various embodiments of the present invention relate to packing and shipping assemblies for bottles comprising a fiber-based (or pulp-based) bottom receptacle for receiving a plurality of bottles, a planar divider for separating the bottles, and an optional cap component configured to retain the divider on the bottles during shipping. In a preferred embodiment the separator comprises a single or double fluted corrugated cardboard material, although the separator may comprise any suitable material including foam, paper foam, plastic, polyethylene foam, packing foam, styrene-butadiene block copolymers (e.g., SBS), or plastic.

Figure 1:
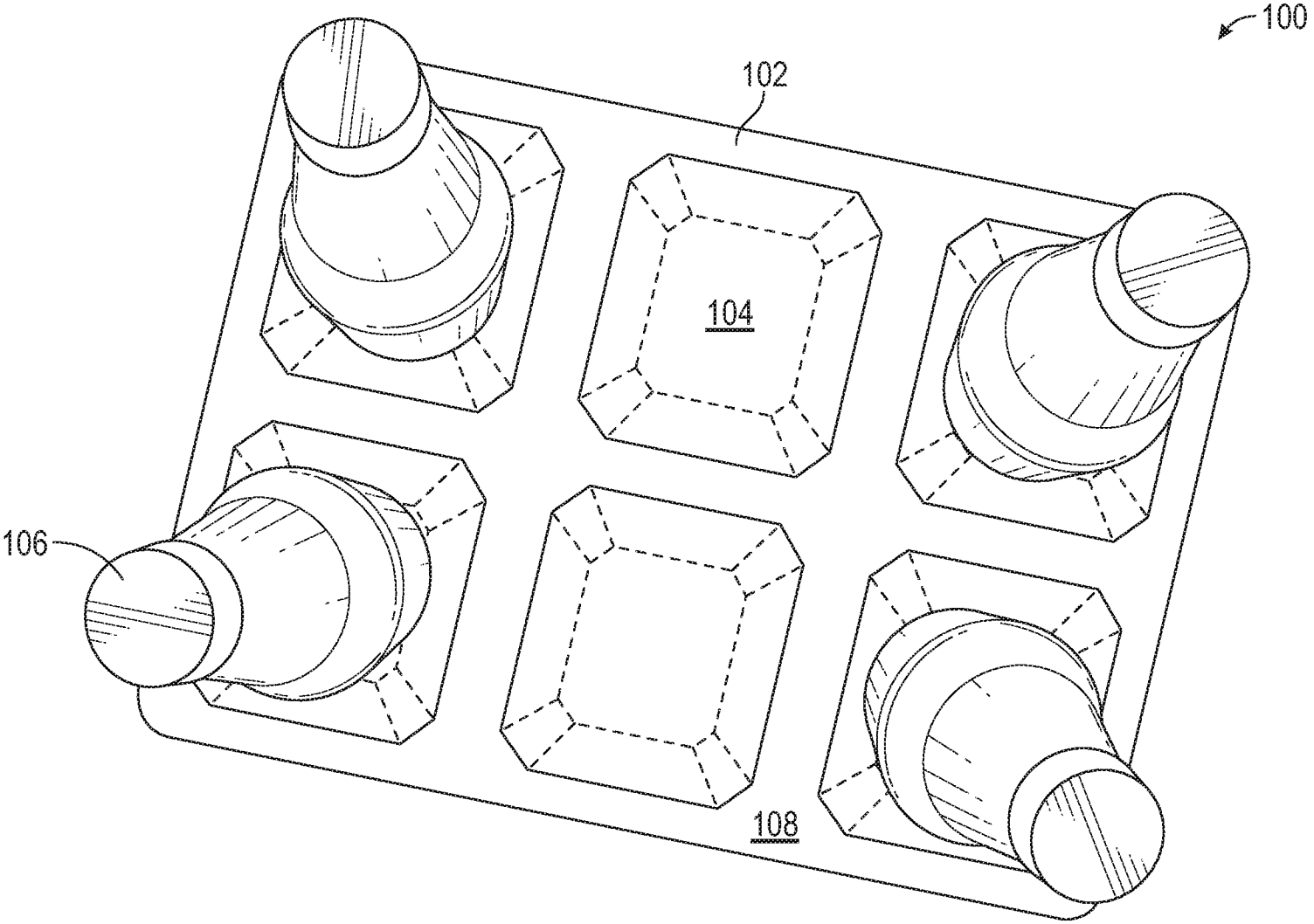
FIG. 1 (Prior Art)
FIG. 1 is a top view of an exemplary prior art bottom packaging component having a plurality of bottles disposed therein in accordance with various embodiments.

Referring now to FIG. 1, an exemplary prior art shipping container 100 includes a bottom packaging component 102 having a plurality of concave receptacles 104 for receiving a plurality of respective bottles 106 therein. The bottom component 102 may also include a top surface 108 against which a bottom surface of a corresponding cap component (not shown in FIG. 1) is configured to abut.

Figure 2:
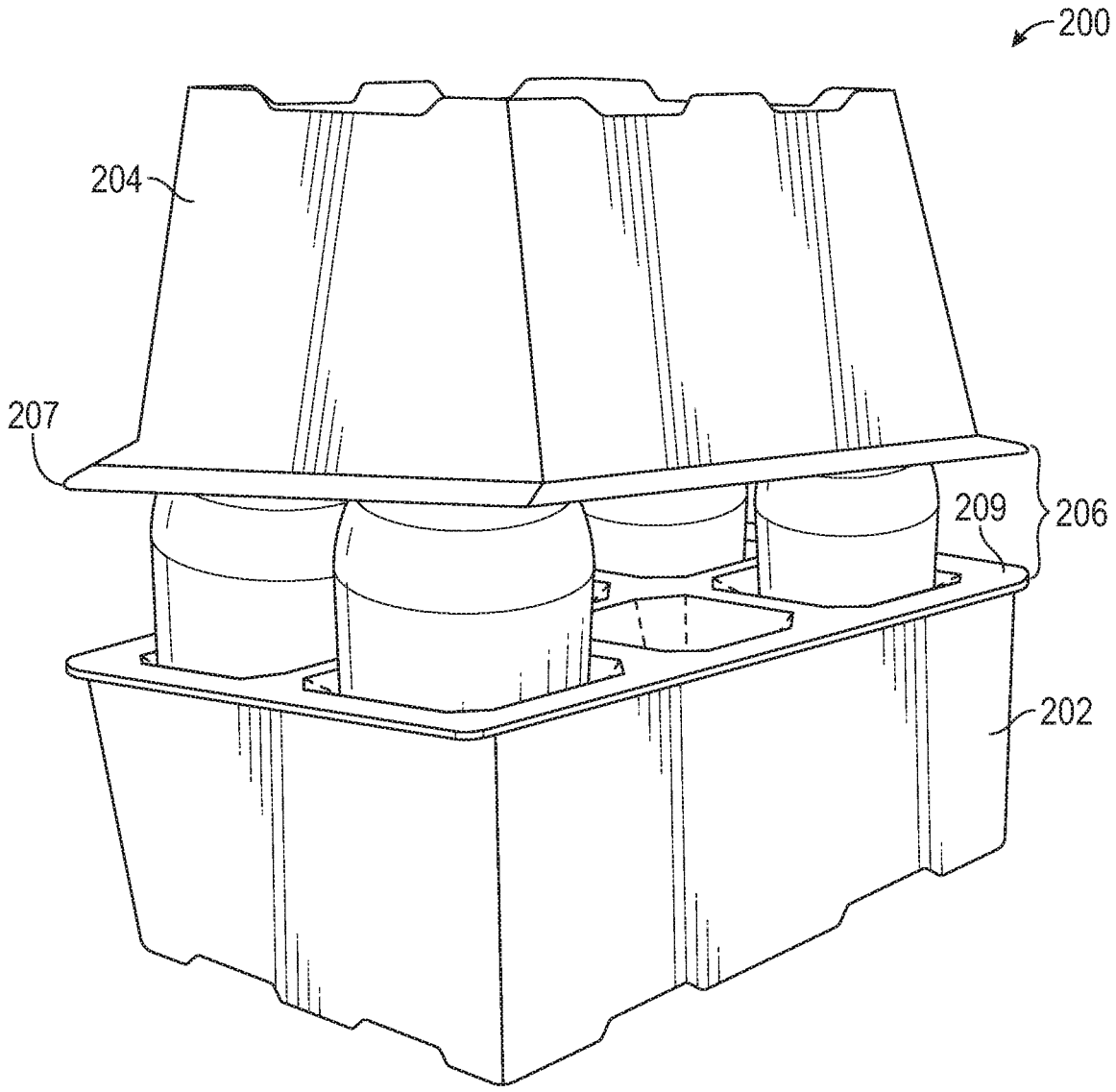
FIG. 2 (Prior Art)
FIG. 2 is a side view of an exemplary prior art packaging system further including a cap portion for securing the tops of the bottles therein, showing a gap between the top of the bottom component and the bottom of the top component in accordance with various embodiments.

FIG. 2 depicts an exemplary prior art packaging system 200 including a bottom component 202 and a top (cap) component 204 for securing the tops of the bottles therein. Due to various factors including differences in bottle sizes/heights and limitations in vacuum molding manufacturing, a gap 206 often results between a bottom surface 207 of top component 204 and a top surface 209 of bottom component 202. Consequently, prior art packaging systems employ an interleaved spacer to fill the gap, as described below in conjunction with FIG. 3.

Figure 3:
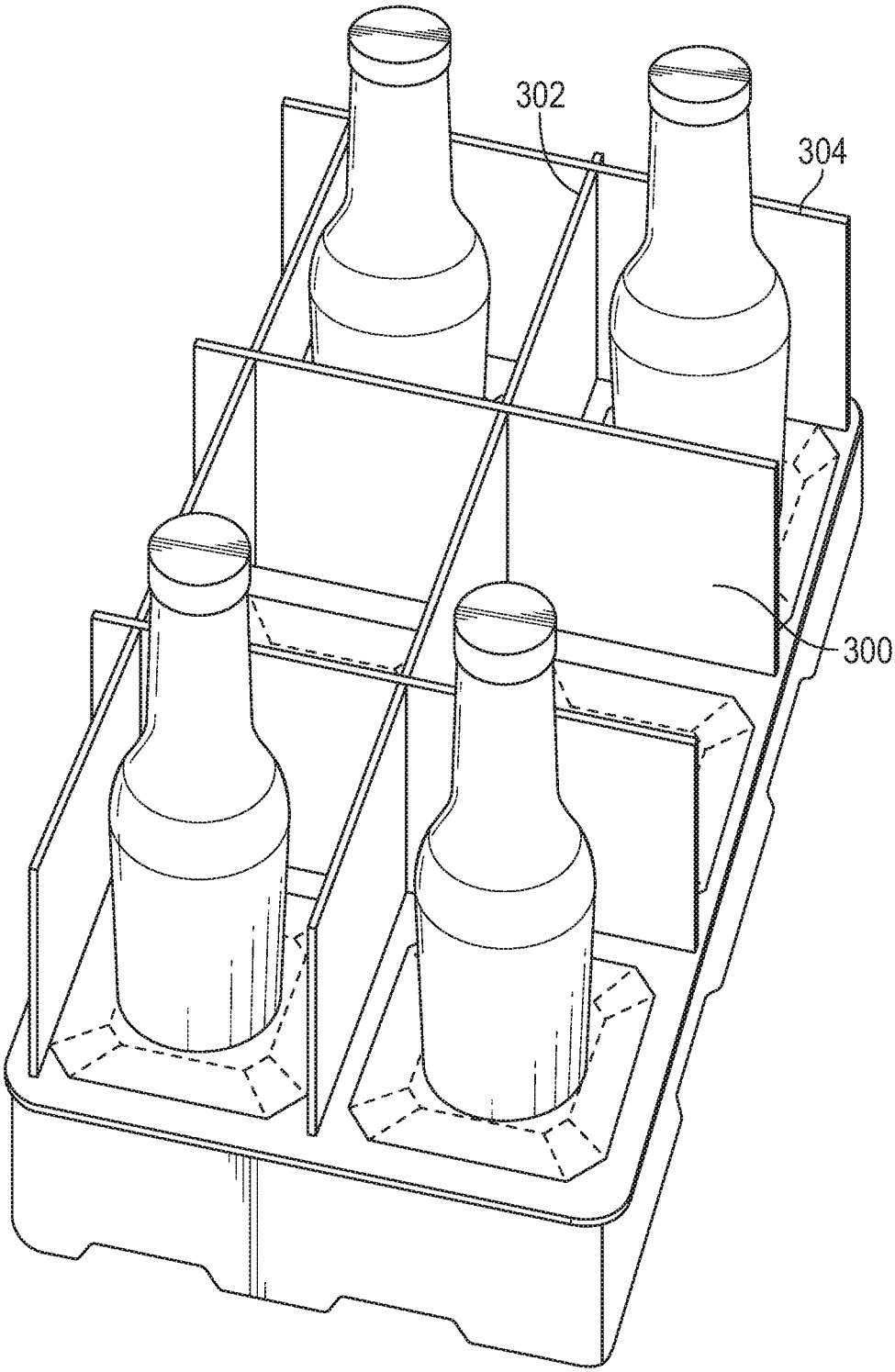
FIG. 3 (Prior Art)
FIG. 3 is a perspective view of an exemplary prior art packaging system including a corrugated divider disposed within the aforementioned gap, the divider including interleaved orthogonal vertical segments extending between adjacent bottles in accordance with various embodiments.

More particularly, FIG. 3 is a perspective view of an exemplary prior art packaging system including a corrugated divider 300 disposed within the aforementioned gap 206 (See FIG. 2), the divider including interleaved orthogonal vertical segments 302, 304 extending between adjacent bottles.

Figure 4:
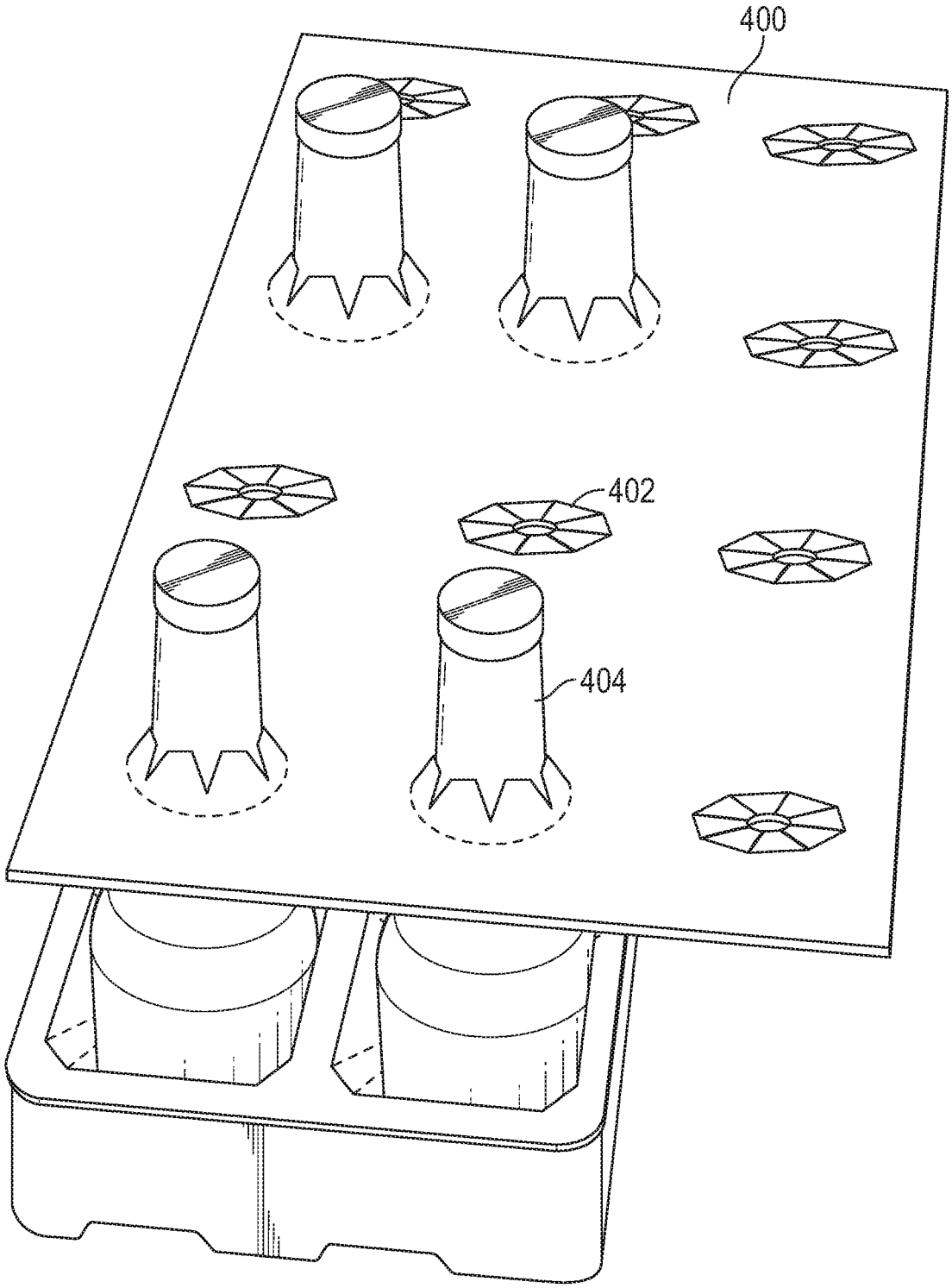
FIG. 4 is perspective view of a planar bottle separator designed to replace the interleaved divider of FIG. 3, the separator including a plurality expandable holes for receiving bottle necks therethrough in accordance with various embodiments.

Referring now to FIG. 4, the present invention replaces the aforementioned three dimensional divider with a substantially planar (two dimensional) bottle separator 400, the separator including a plurality expandable holes 402 for receiving bottle necks 404 therethrough. The bottles may be retained within an outer corrugated box 408 (or alternatively, in one of the other illustrated boxes such as the outer corrugated box of FIG. 2 comprising items 202 and 204). In various embodiments, the separator may include any desired number of holes such as, for example, a regular arrangement of 2, 3, 4, 6, 8, 9, 12, 15, 16, 18, 21, or 24 holes. As described in greater detail below, the holes may include perforated or pre-cut extensions which allow the holes to flare open when the increasing diameter (or other cross section) of a bottle is urged therethrough.

Figure 5:
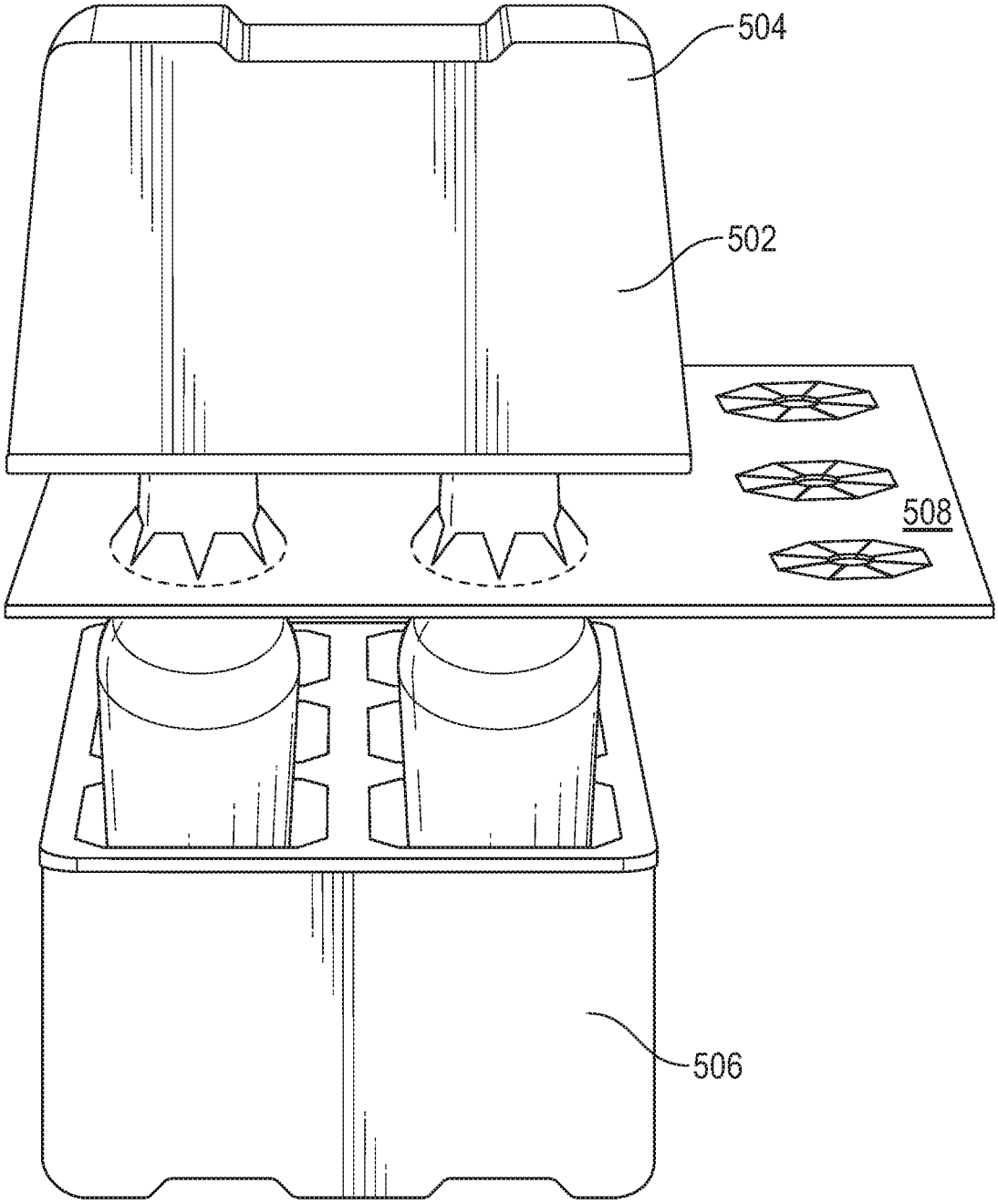
FIG. 5 is a side view of the assembly of FIG. 4, further including an optional top component including a plurality of generally conical segments for receiving the bottle tops in accordance with various embodiments.

FIG. 5 is a side elevation view of the assembly of FIG. 4, further including an optional top component (cap) 502 including a plurality of concave (generally conical) segments 504 for receiving the bottle tops. The bottles may thus be received within a bottom component 506, spaced apart from one another by a separator 508 in accordance with the present invention, and further secured by the cap 502.

Figure 6:
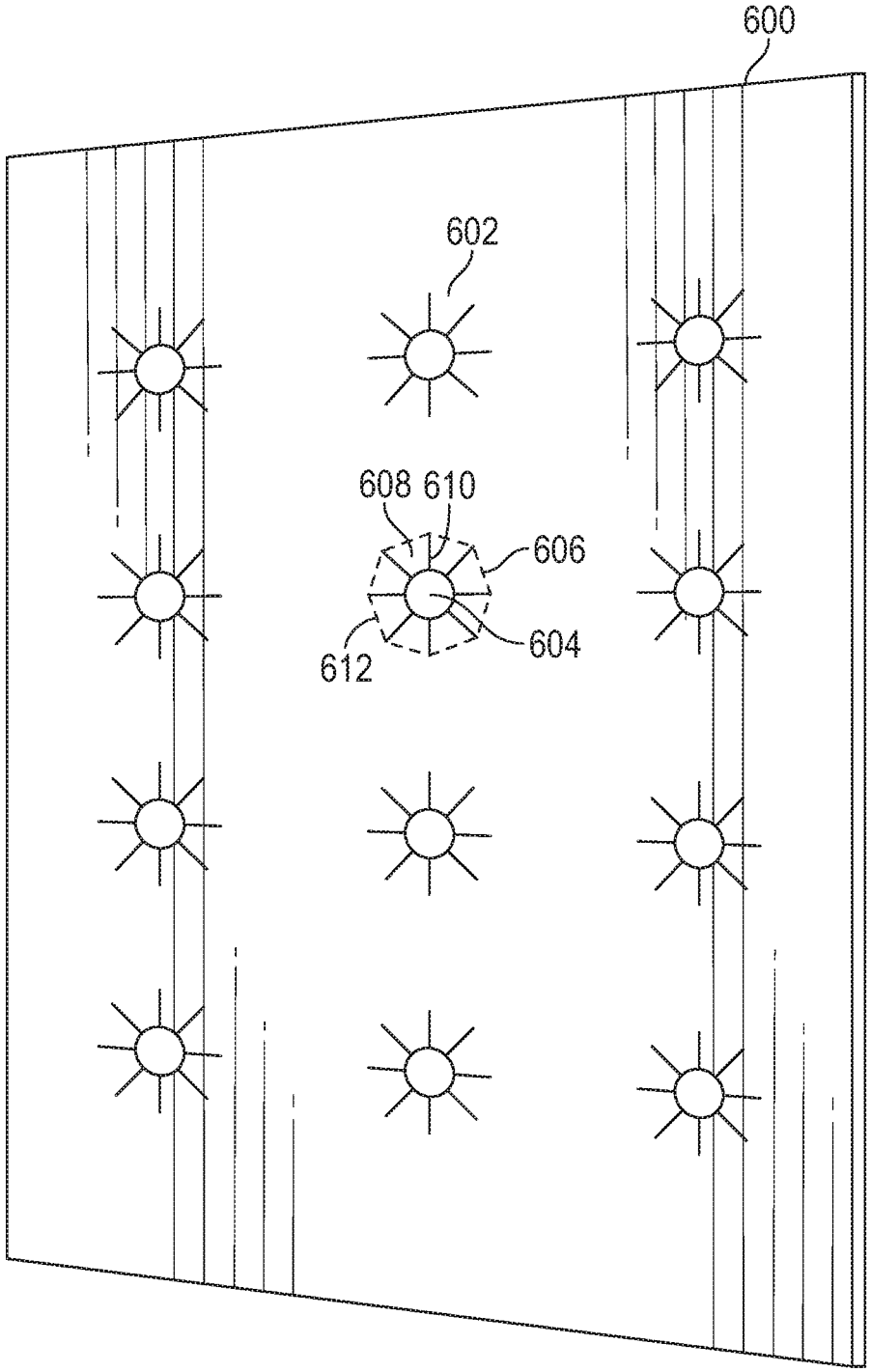
FIG. 6 is a plan view of the separator shown in FIGS. 4 and 5 in accordance with various embodiments.

FIGS. 6 is a plan view of an exemplary separator 600 including a plurality of expandable bottle neck receptors (holes) 602, one or more of which may be characterized by a through hole 604, and an expandable circumferential component 606 surrounding the through hole. In the illustrated embodiment, the expandable circumferential component 606 includes a plurality (e.g., 3, 4, 5, 6, 8, 9, 10 or more) of (e.g., trapezoidal) segments 608 separated by perforated or pre-cut lines 610. In addition, one or more segments 608 may include a creased, scored, or otherwise pre-folded pivot line 612 to facilitate the outward flaring of the segments 608 as a bottle neck passes through the receptor 602. In an embodiment, the expandable circumferential component suitably exhibits rotational symmetry, regardless of the number of segments.

Figure 7:
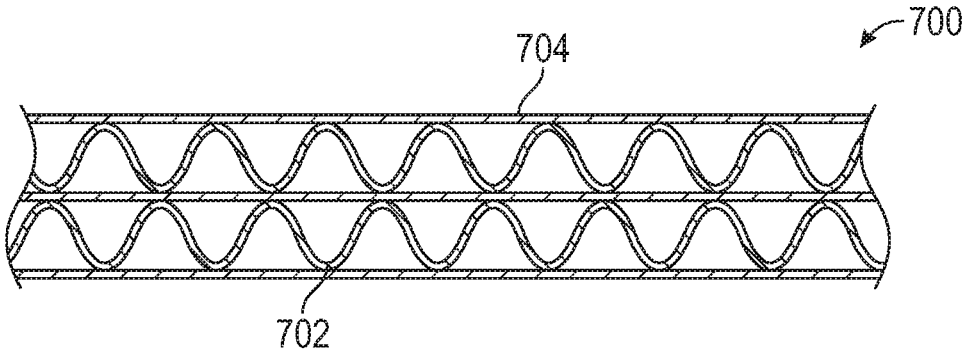
FIG. 7 is an edge view of the separator depicting a double flute configuration in accordance with various embodiments.

FIG. 7 is an edge view (also a cross-section view) of an exemplary separator 700 having a double flute configuration including a first fluted portion 702 and an adjacent, second fluted portion 704.

Figure 8:
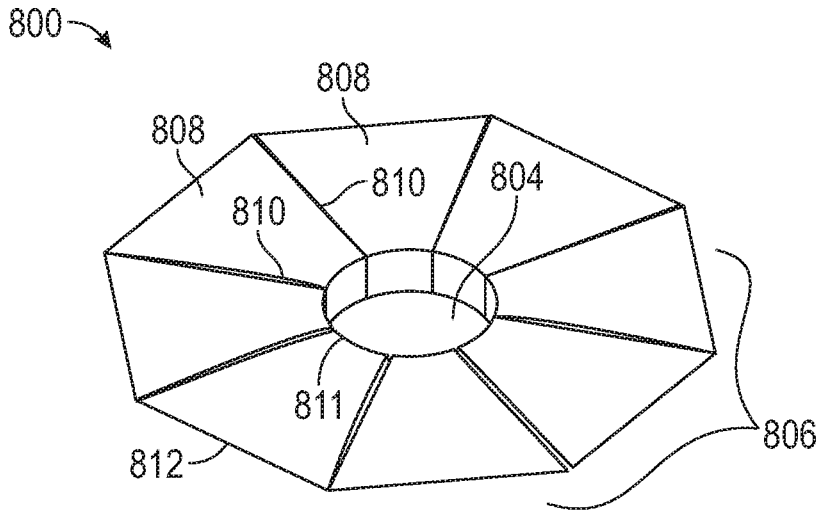
FIG. 8 is a close up view of a partially expanded receptor viewed from the top of the planar separator in accordance with various embodiments.
Figure 9:
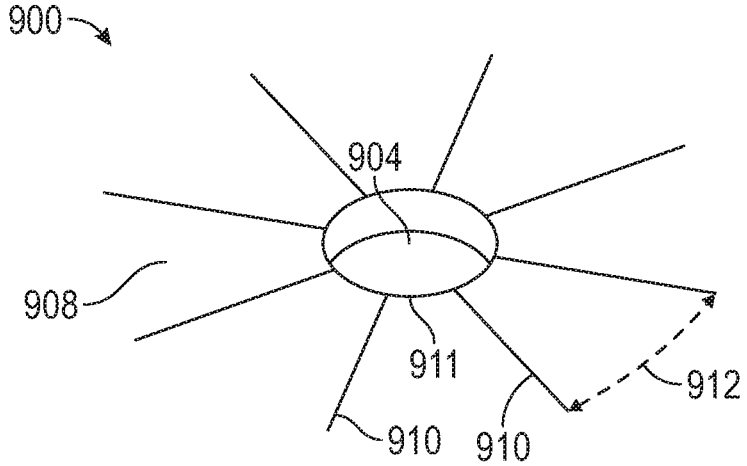
FIG. 9 is a close-up view of an unexpanded receptor viewed from the bottom of the planar separator in accordance with various embodiments.

FIGS. 8 and 9 are close up views of exemplary bottle neck receptors viewed from the top and bottom of the planar separator, respectively. Specifically, FIG. 8 depicts a partially expanded receptor 800 viewed from the top of the planar separator, and FIG. 9 depicts an unexpanded receptor 900 viewed from the bottom of the planar separator.

More particularly and with continued reference to FIG. 8, an exemplary segment 808 is bounded by respective cut lines 810, bend (or pivot) line 812, and a preferably arcuate edge 811 surrounding the hole 804. When viewed from the top of the planar separator, the segments 808 bend upwardly along line 812 as the bottle neck (not shown in FIG. 8; see FIG. 4) is urged upwardly through the hole 804. The edge 811 slides along the length of the bottle neck as the separator is (typically manually) urged downwardly over the bottle necks to expand the circumferential region 806 about an associated bottle. In an embodiment, line 812 also functions as a visual indicator of the orientation of the planar separator. That is, when the separator is viewed from the top, line 812 is visible; when viewed from the bottom, line 812 is not visible. In other embodiments, line 812 may comprise a textual, graphical, printed, embossed, or decal for indicating the top (as opposed to the bottom) of the planar separator.

Returning momentarily to FIG. 9, when viewed from the bottom of the planar separator, each segment 908 bends downwardly along line 912 as the bottle neck proceeds through the hole 904.

FIG. 10 illustrates an exemplary separator 1002 including a plurality of expandable receptors 1004 configured to secure a plurality of bottles 1006 within an outer box or container in accordance with various embodiments. For clarity, the outer box is not shown in FIG. 10; but see, for example: items 202 and 204 of FIG. 2; item 408 in FIG. 4; item 506 in FIG. and item 1404 in FIG. 14. A cap portion (not shown in FIG. 10; but see, e.g., item 204 in FIG. 2) may also be place on top of the bottles to further secure them within the shipping container, if desired.

Figure 11:
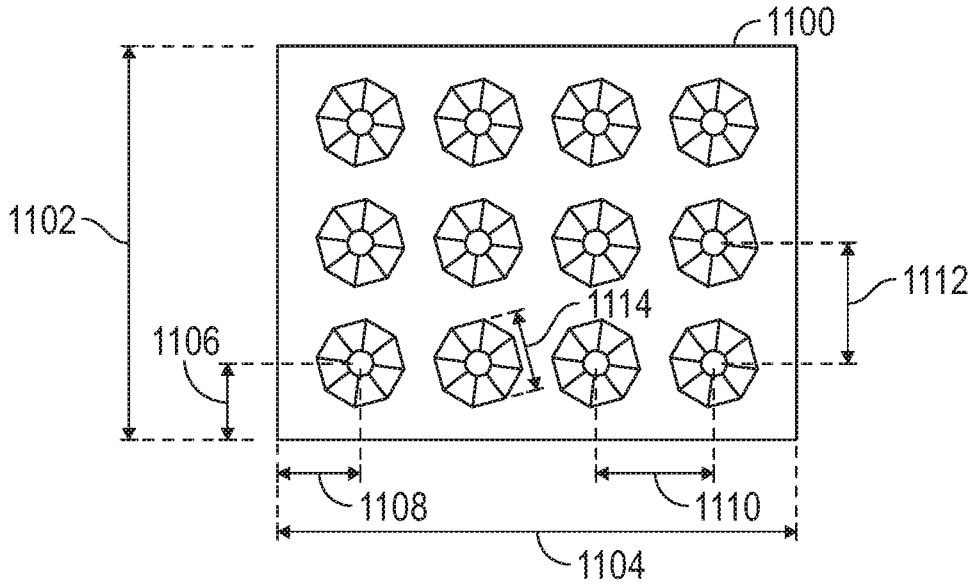
FIG. 11 is a schematic diagram of a first exemplary separator depicting various dimensions in accordance with various embodiments.

FIG. 11 illustrates a first exemplary separator 1100 characterized by: a width dimension 1102 (in the range of 10 to 18 inches, and preferably about 14 7/16 inches); a length dimension 1104 (in the range of 14 to 22 inches, and preferably about 18 5/16 inches); a width border dimension 1106 (in the range of 1 to 4 inches, and preferably about 2 13/16 inches); a length border dimension 1108 (in the range of 1 to 4 inches, and preferably about 2 5/16 inches); a lengthwise receptor center-to-center dimension 1110 in the range of 2 to 6 inches, and preferably about 4 1/4 inches); a widthwise receptor center-to-center dimension 1112 in the range of 2 to 6 inches, and preferably about 4 1/4 inches); and a tangential receptor dimension 1114 in the range of 1 to 5 inches, and preferably about 2 15/16 inches).

Figure 12:
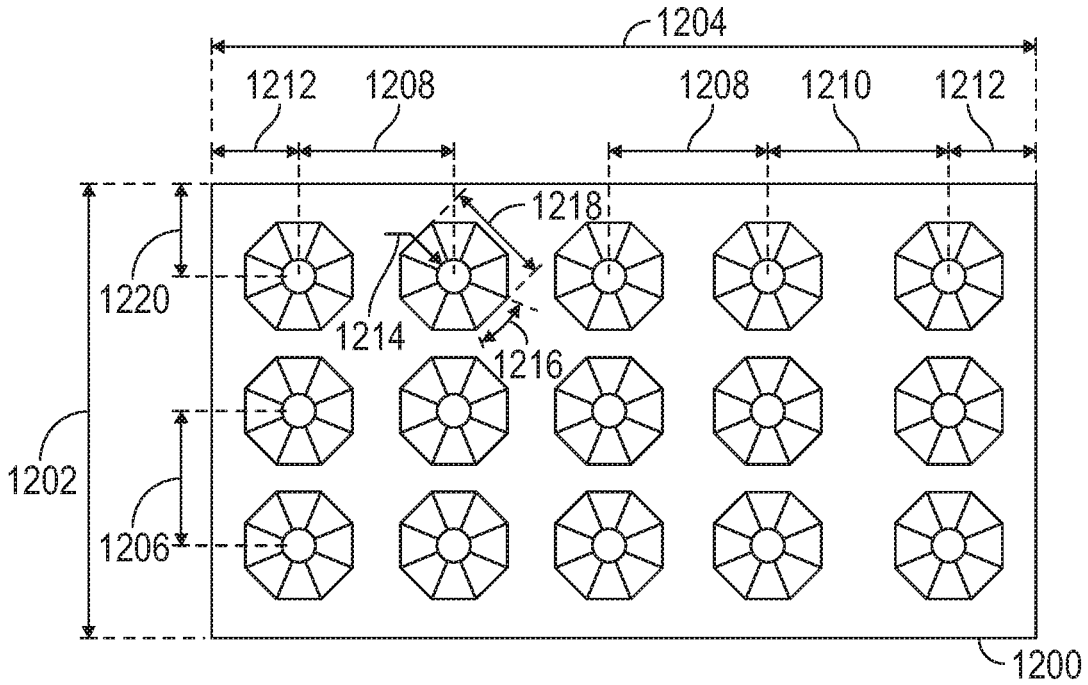
FIG. 12 is a schematic diagram of a second exemplary separator depicting various dimensions in accordance with various embodiments.

FIG. 12 illustrates a second exemplary separator 1200 characterized by: a width dimension 1202 (in the range of 11 to 13 inches, and preferably about 13.3 inches); a length dimension 1204 (in the range of 20 to 28 inches, and preferably about 24.2 inches); a width border dimension 1220 (in the range of 1 to 4 inches, and preferably about 2.7 inches); a length border dimension 1212 (in the range of 1 to 4 inches, and preferably about 2.5 inches); a lengthwise receptor center-to-center dimension 1208 in the range of 2 to 6 inches, and preferably about 4.6 inches); a widthwise receptor center-to-center dimension 1220 in the range of 2 to 6 inches, and preferably about 3.9 inches); a right side lengthwise border dimension 1210 (in the range of 4 to 6 inches, and preferably about 5.3 inches); a hole dimension (e.g., diameter) in the range of 0 to 1 inch, and preferably about 0.5 inches); and a tangential receptor dimension 1218 in the range of 1 to 5 inches, and preferably about 3.1 inches).

In the illustrated embodiment in which a receptor comprises a plurality (e.g., 8) of folding segments, each segment comprises a circumferential dimension 1216 in the range of 20 to 90 degrees, and in the case of eight segments, approximately 45 degrees. An exemplary hole dimension 1214 may be in the range of 0 to 1 inch, and preferably about 0.5 inches. In an embodiment, a hole may be diminishingly small, as long as the cut lines defining the pivoting flaps extend substantially or all the way through the separator. By simply creasing or scoring, as opposed to cutting the flap pivot lines, the flap's resistance to further folding assists in restraining the bottles from lateral movement during shipment.

In an embodiment, the hole may be stamped, die cut, or otherwise formed in a way which produces a smooth internal edge to avoid scratching the bottle label. Alternatively or in addition to the foregoing, the internal edge of the hole may be smoothed, for example by de-burring, sanding, or through the use of a moving abrasive material in a subsequent processing step after forming the hole. The hole size may be a function of the bottle neck diameter.

Figure 13:
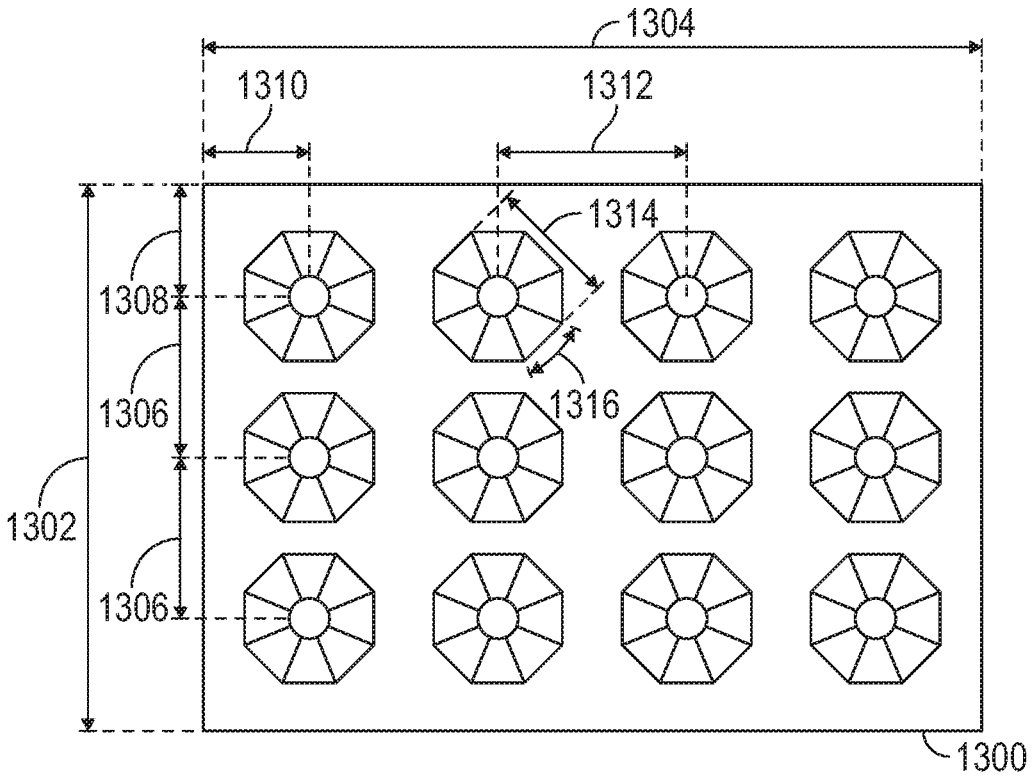
FIG. 13 is a schematic diagram of a third exemplary separator depicting various dimensions in accordance with various embodiments.

FIG. 13 illustrates a third exemplary separator 1300 characterized by: a width dimension 1302 (in the range of 10 to 16 inches, and preferably about 13.3 inches); a length dimension 1304 (in the range of 14 to 22 inches, and preferably about 18.9 inches); a width border dimension 1308 (in the range of 2.5 to 3.5 inches, and preferably about 2.7 inches); a length border dimension 1310 (in the range of 1 to 4 inches, and preferably about 2.56 inches); a lengthwise receptor center-to-center dimension 1312 in the range of 2 to 6 inches, and preferably about 4.6 inches); a widthwise receptor center-to-center dimension 1306 in the range of 2 to 6 inches, and preferably about 3.9 or about 4.2 inches); and a tangential receptor dimension 1314 in the range of 2.5 to 3.5 inches, and preferably about 3.1 inches).

The separator may comprise single or double walled corrugated cardboard, with an edge crush test (ECT) strength in the range of 26 to 56, and preferably about 32, and/or a Mullen burst strength in the range of 150 to 350 pounds, and preferably about 200 pounds.

Those skilled in the art will appreciate that any combination or sub-combination of dimensions described in conjunction with FIGS. 11-13 may be embodied in a separator according to the present invention.

The separator may employ any desired fluting configuration depending on size, weight, and other relevant design parameters. By way of non-limiting example, an E flute may be used for a 4 pack; B flute for a 6 pack; and a C flute with a 12 pack. In addition, any suitable material and/or any configuration of that or those materials may be employed which satisfy the 3A and 5A drop test ISTA (International Safe Transit Association) protocols. Moreover, regular and irregular hole spacing may be employed to accommodate homogeneous and heterogeneous bottle combinations (to facilitate mixing-and-matching of different bottle sizes and shapes).

The separator may be constructed of any suitable material using any suitable manufacturing method. In the case of a fluted cardboard separator, a die on a die cut machine may be urged downwardly from above to cut the top surface of the planar sheet thereby forming the lines between adjacent folding flaps; the die cut machine may also be configured to (e.g., simultaneously) score the pivot (pre-fold) lines associated with the flaps.

Figure 14:
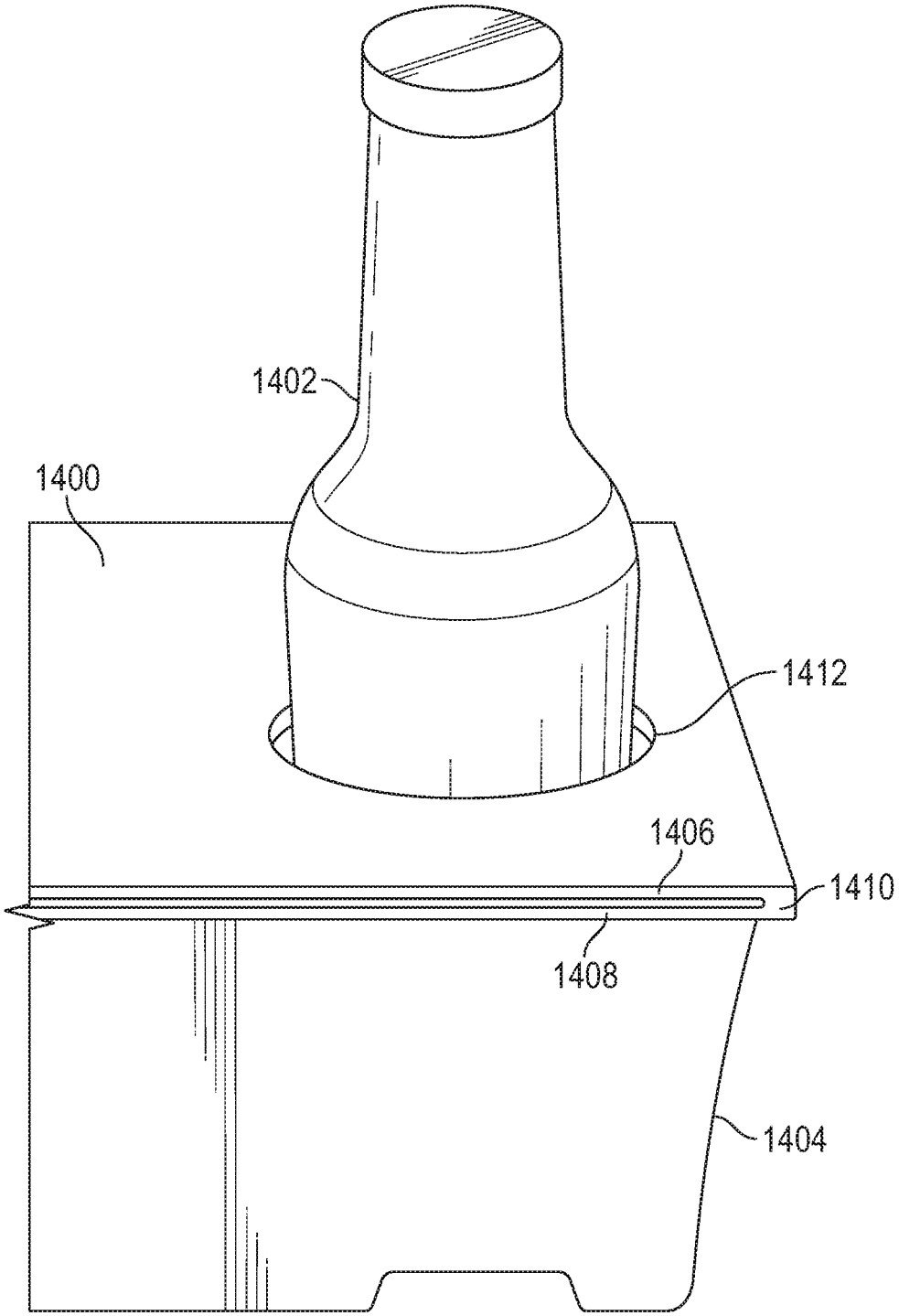
FIG. 14 is a perspective view of an alternate embodiment of a two-tiered separator assembly securing a plurality of wine bottles in accordance with various embodiments.

Referring now to FIG. 14, an alternate embodiment includes a two-tiered separator assembly 1400 for securing one or more wine bottles 1402 within a base component 1404. More particularly, the two-tiered separator assembly 1400 includes a first planar portion 1406 and a second planar portion 1408 folded upon each other about a connecting joint 1410 such as a folding hinge. As described in greater detail below, the first planar portion 1406 preferably includes a plurality of (e.g., circular) cut-outs 1412 for receiving a bottle; second planar portion 1408 preferably includes a plurality of downwardly foldable flaps (not shown in FIG. 14; see FIGS. 15 and 16) for stabilizing the bottom of the bottle. The first and second planar portions 1406, 1408 may comprise single or double fluted corrugate, or any other suitable material as contemplated herein.

Figure 15:
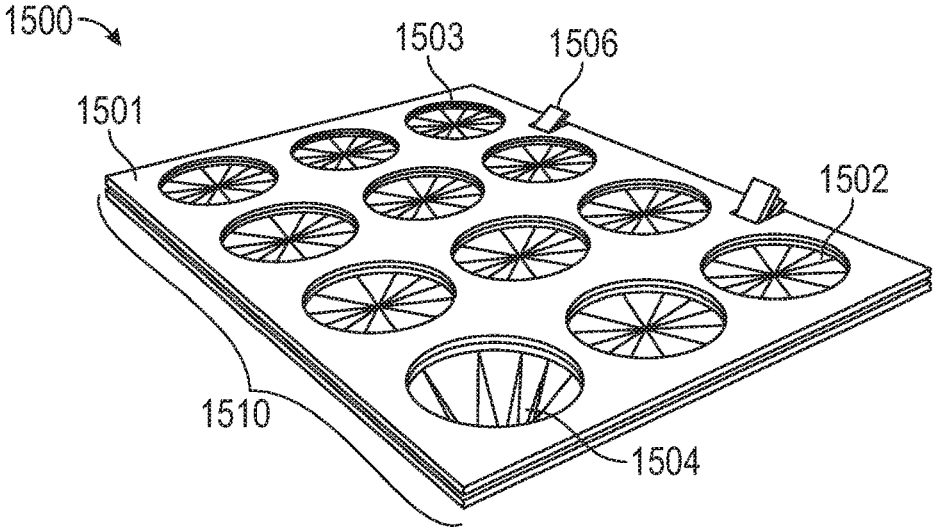
FIG. 15 is a perspective view of the separator assembly of FIG. 14 showing the folded flaps extending downwardly to hold the bottom portion of a bottle in place.

FIG. 15 is a perspective view of an exemplary two-tiered separator assembly 1500 including a top planar component 1501 having a plurality of (e.g., circular) cut-outs 1503, and a bottom planar component (substantially hidden from view in FIG. 15) having a plurality of flap assemblies including a first assembly 1502 showing the flaps in a closed position and a second assembly 1504 showing the flaps in the downwardly extended position. The top and bottom planar component are suitably hingedly connected, for example along a perforated, scored, and/or creased binding 1510. A fastener 1506 may be employed to retain the assembly in the folded position shown; that is, to maintain axial alignment of the cut-outs 1503 relative to their corresponding flap assemblies 1502, 1504. Although the fastener 1506 is depicted as a foldable tab inserted into a rectangular docking port, those skilled in the art will appreciate that any suitable mechanism for (e.g., releasably) securing the top and bottom planar components together will suffice.

Figure 16:
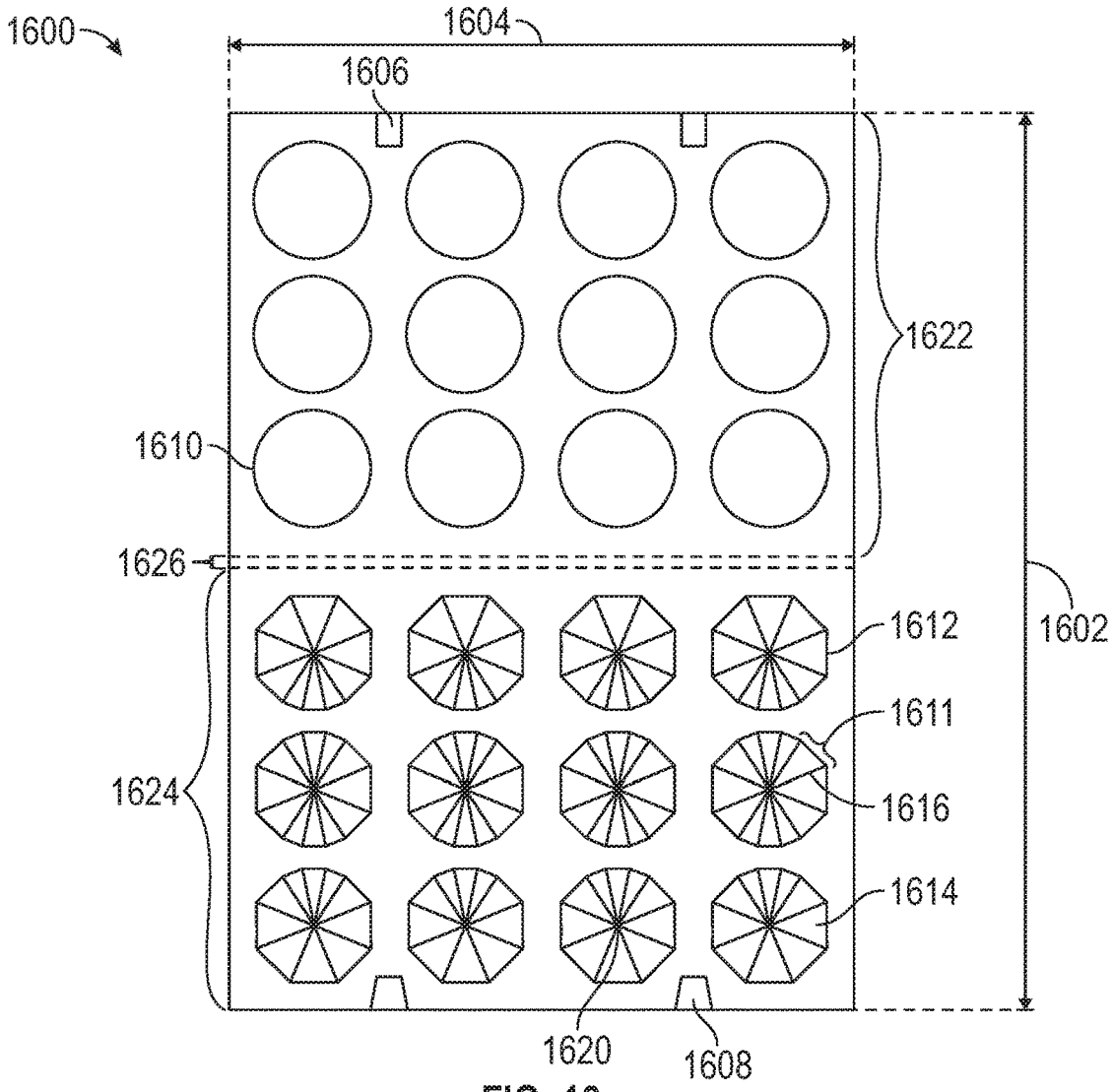
FIG. 16 is a top plan view of the two tiered separator assembly of FIGS. 14 and 15, shown in the unfolded (planar) position.

Referring now to FIG. 16, an exemplary two tiered separator assembly 1600 is shown in the unfolded (planar) position. Two tiered separator assembly 1600 is characterized by a lengthwise dimension 1602 (e.g., in the range of 24 to 30 inches, and preferably about 27 inches; and a width dimension 1604 (e.g., in the range of 16 to 22 inches, and preferably about 18.9 inches).

With continued reference to FIG. 16, the assembly includes a top planar component 1622 including a plurality of cut-outs 1610, and a bottom planar component 1624 including a plurality of flap assemblies 1612. In an embodiment, each flap assembly includes a plurality of substantially triangular flaps 1614 bounded by cut lines 1616 and pivotable (bendable) about a pivot line 1611. The top and bottom planar components 1622, 1624 may be foldable about a hinge 1626, as described above. When the top and bottom components are folded upon (and hence parallel to) each other, one or more tabs 1606 may be pressed into a corresponding dock 1608 to maintain the assembly in the folded over condition.

FIG. 17 is a side elevation view of the assembly in FIG. 10, further including an optional top component (cap) 502 including a plurality of concave (generally conical) segments 504 for receiving the bottle tops, where the bottles are received within a bottom component 506. A visual indicia of orientation 1704 is provided. The assembly, top component 502, and the bottom component 506 are placed within a corrugated outer box 1702.

While the present invention has been described in the context of wine bottles, it will be appreciated that the invention is not so limited. For example, the separator may be used for any fragile items which include an upwardly extending neck portion such as ceramic or other compositions. Moreover, the various geometric features and dimensions may be adjusted to accommodate additional applications based on the teachings of the present invention.

A shipping container is provided, comprising: a vacuum molded base component having a plurality of cylindrical concave columns within which respective bottles are received; a substantially planar corrugated separator sheet having a plurality of receptors aligned with the axes of the columns and configured to slidably receive respective bottle necks associated with the bottles; a vacuum molded cap component for receiving the bottle necks therewithin; and an outer corrugated box within which the bottles, base component, separator, cap component components are securely disposed.

In an embodiment, the separator comprises a double fluted structure.

In an embodiment, at least one of the receptors comprises a through hole surrounded by an expandable circumferential component.

In an embodiment, the expandable circumferential component comprises a plurality of segments separated by pre-cut lines.

In an embodiment, the expandable circumferential component suitably exhibits rotational symmetry.

In an embodiment, the expandable circumferential component further comprises a pivot line; and at least one segment is configured to bend about the pivot line to facilitate the outward flaring of the segment as a bottle neck passes through the associated receptor.

In an embodiment, the pivot line comprises at least one of a creased line, a scored line, and a pre-folded line on an upper surface of the separator.

In an embodiment, the separator includes an even number of segments.

In an embodiment, the separator comprises visual indicia of orientation.

In an embodiment, the visual indicia of orientation comprises one of a textual and graphical orientation instruction.

In an embodiment, the visual indicia of orientation comprises one of a printed, embossed, and decal applied to a surface of a top surface of the separator.

A shipping container is provided, the shipping container being of the type including a vacuum molded base component having a plurality of cylindrical concave columns within which bottom portions of bottles are received, and a vacuum molded cap component within which top portions of the bottles are received. In an embodiment, the shipping container further includes a substantially planar separator sheet having a plurality of receptors aligned with the axes of the bottles and configured to slidably receive respective bottle necks therethrough.

In an embodiment, at least one of the receptors comprises: a central through hole; and an expandable region circumferentially disposed about the through hole.

In an embodiment, the expandable region comprises a plurality of flaps configured to bend about respective pivot lines in response to a bottle neck passing therethrough.

In an embodiment, the plurality of flaps are bounded by die cut lines.

In an embodiment, the central hole comprises a diameter of approximately 0.5 inches; and the expandable region is characterized by a tangential dimension in the range of about 2 to 4 inches.

In an embodiment, the die cut lines extend through the plane of the separator; and the pivot lines do not extend through the plane of the separator.

In an embodiment, the separator comprises a rectangular matrix of receptors spaced apart from each other by a distance in the range of 3 to 4 inches.

A method of packaging bottles of the type including a bottom portion and a neck is provided. The method includes: placing the bottom portions into a base component having a plurality of concave columns within which the bottom portions are received; sliding a substantially planar separator sheet over the bottle necks; placing a cap component over the bottles, the cap component comprising a plurality of recesses within which respective necks are received; and placing the assembled base component, bottles, separator sheet, and cap component into a box.

In an embodiment, the separator sheet comprises a plurality of holes each surrounded by foldable flaps bounded by preformed fold lines.

As used herein, the word "exemplary" means "serving as an example, instance, or illustration." Any implementation described herein as "exemplary" is not necessarily to be construed as preferred or advantageous over other implementations, nor is it intended to be construed as a model that must be literally duplicated.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

The invention claimed is:

1. A shipping container, comprising:

a fiber-based, vacuum molded base component having a plurality of cylindrical concave columns within which respective bottles are received;

a substantially planar corrugated separator sheet characterized by two pairs of opposing sides defining four corners, wherein each side is parallel to another side along the entire length of the sides between adjacent corners, the separator sheet having a plurality of receptors aligned with the axes of the columns and configured to slidably receive respective bottle necks associated with the bottles;

a vacuum molded cap component for receiving the bottle necks therewithin; and an outer corrugated box within which the bottles, base component, separator sheet, cap component components are securely disposed;

wherein the base, separator sheet, cap, and box cooperate to restrain the bottles within the box and to avoid contact between adjacent bottles during shipment;

wherein the receptors each comprise a through hole surrounded by an expandable circumferential component including a plurality of segments separated by pre-cut lines, wherein the plurality of segments have a radial length that is greater than a diameter of the through hole;

wherein the separator sheet comprises top and bottom planar components foldable about a hinge, and a fastener is provided for retaining the separator sheet in a folded position and maintaining axial alignment of the through-holes, further wherein the expandable circumferential component is provided in only one of the top and bottom planar components.

2. The shipping container of claim 1, wherein the separator sheet comprises a double fluted structure.

3. The shipping container of claim 1, wherein the expandable circumferential component suitably exhibits rotational symmetry.

4. The shipping container of claim 3, wherein:

the expandable circumferential component further comprises a pivot line; and at least one segment is configured to bend about the pivot line to facilitate the outward flaring of the segment as a bottle neck passes through the associated receptor.

5. The shipping container of claim 4, wherein the pivot line comprises at least one of a creased line, a scored line, and a pre-folded line on an upper surface of the separator sheet.

6. The shipping container of claim 5, wherein the separator comprises an even number of segments.

7. The shipping container of claim 1, wherein the separator sheet comprises visual indicia of orientation.

8. The shipping container of claim 7, wherein the visual indicia of orientation comprises one of a textual and graphical orientation instruction.

9. The shipping container of claim 8, wherein the visual indicia of orientation comprises one of a printed, embossed, and decal applied to a surface of a top surface of the separator sheet.

10. The shipping container of claim 1, wherein the fastener is a foldable tab incorporated into the separator sheet.

* * * * *